US006109688A

United States Patent [19]

Wurz et al.

[11] Patent Number: 6,109,688

[45] Date of Patent: Aug. 29, 2000

[54] SEAT, SQUAB OR COUCH UPHOLSTERY

[75] Inventors: Dieter Wurz, Gartenweg 7, D-76530, Baden-Baden; Stefan Hartig, Achrn, both of Germany

[73] Assignee: Dieter Wurz, Germany

[21] Appl. No.: 09/194,941

[22] PCT Filed: May 12, 1997

[86] PCT No.: PCT/EP97/02419

§ 371 Date: Dec. 7, 1998

§ 102(e) Date: Dec. 7, 1998

[87] PCT Pub. No.: WO97/47220

PCT Pub. Date: Dec. 18, 1997

[30] Foreign Application Priority Data

Jun. 7, 1996 [DE] Germany ..... 196 22 932
Aug. 26, 1996 [DE] Germany ..... 196 34 430

[51] Int. Cl.[7] ..... A47C 31/00; A47C 7/72

[52] U.S. Cl. ..... 297/180.14; 297/180.13; 297/180.16; 297/452.42; 297/452.44; 297/452.47; 5/652.2; 5/653

[58] Field of Search ..... 297/180.16, 452.42, 297/452.43, 452.44, 452.45, 452.46, 452.47, 180.11, 180.13, 180.14, 180.15, 180.1; 5/726, 713, 652.2, 653

[56] References Cited

U.S. PATENT DOCUMENTS

| | | | |
|---|---|---|---|
| 2,012,042 | 8/1935 | Gerlofson et al. | 297/452.47 |
| 3,266,064 | 8/1966 | Figman | 5/726 X |
| 3,331,089 | 7/1967 | Ornas et al. | 297/452.46 |
| 3,506,308 | 4/1970 | Fenton | 297/452.47 X |
| 3,736,022 | 5/1973 | Radke | 297/452.43 |
| 5,004,294 | 4/1991 | Lin . | |
| 5,226,188 | 7/1993 | Liou . | |
| 5,403,065 | 4/1995 | Callerio | 297/452.43 |
| 5,405,179 | 4/1995 | Jih | 297/452.42 |
| 5,590,428 | 1/1997 | Roter | 5/726 X |

FOREIGN PATENT DOCUMENTS

| | | |
|---|---|---|
| 0 689 786 A1 | 1/1996 | European Pat. Off. . |
| 24 58 494 A | 7/1976 | Germany . |
| 95/ 14 409 A1 | 6/1995 | WIPO . |
| 96/ 05 475 A1 | 2/1996 | WIPO . |

*Primary Examiner*—Anthony D. Barfield
*Attorney, Agent, or Firm*—Roger & Killeen

[57] ABSTRACT

Upholstery for a seat, rest or couch. The upholstery includes internal channels through which draining air may flow. Valve means that open under load or compression control air flow through the channels. The flow of draining air is increased automatically or given a desired flow distribution by the surface area pressure controlled by a seated person. The cross sections of the valve means and the channels may be designed so that even a very small pressure difference and correspondingly little energy expenditure will provide a satisfactory air flow rate.

6 Claims, 6 Drawing Sheets

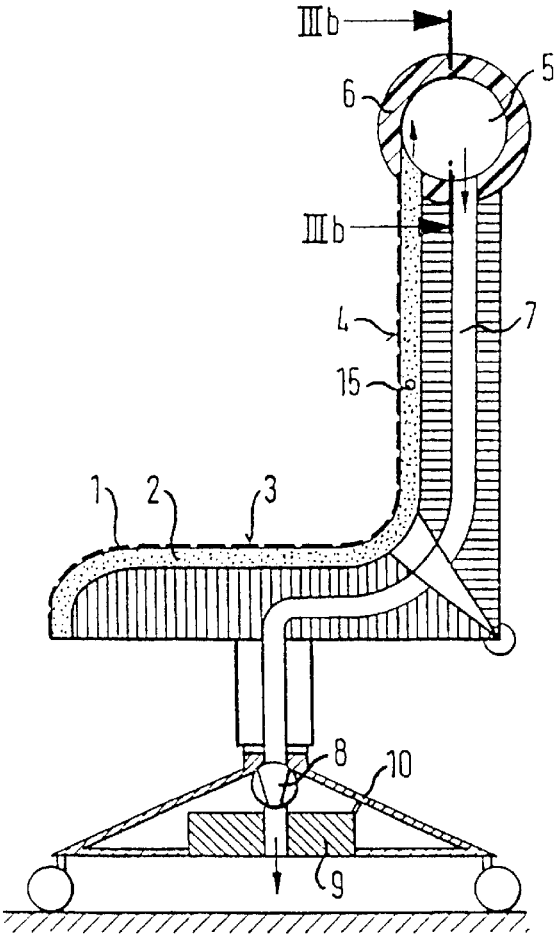
FIG. 1
FIG. 2
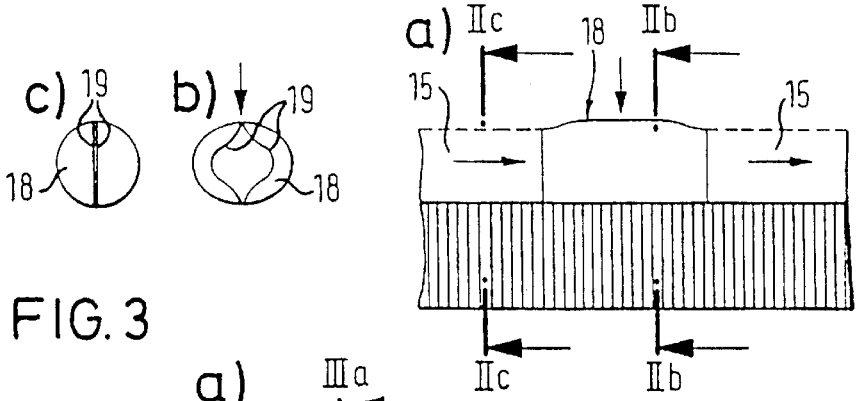
FIG. 3
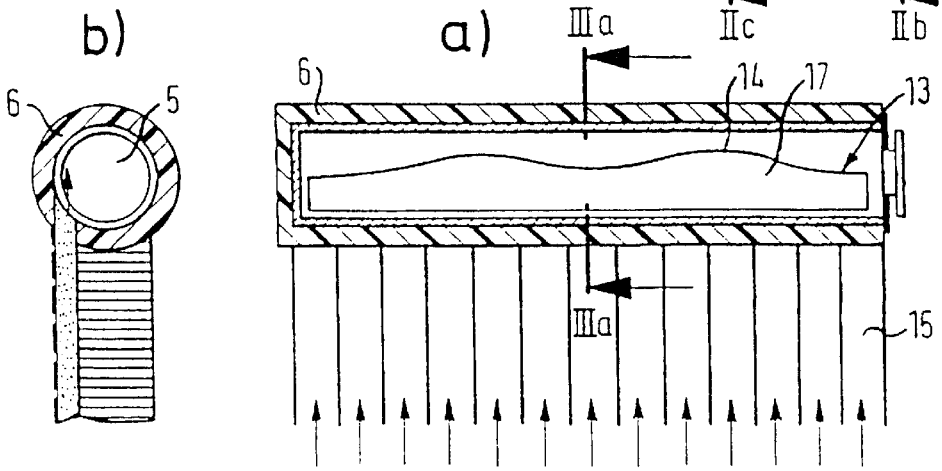

SEAT, SQUAB OR COUCH UPHOLSTERY

The invention relates to seat, rest, or couch upholstery and its general object is to improve the ventilation of that type of upholstery.

It is a nuisance to perspire when sitting on a chair, a swivel armchair at a desk, or a seat in a car, usually equipped with strong thermal insulation. Bed ridden patients and senior citizens who have to spend a lot of time reposing often complain about a lack of ventilation of their beds and frequently suffer bedsores.

It is a problem with the ventilation of seats or beds that the customary type of upholstery is compressed under the weight of the person sitting or lying on it, whereby ventilation normally is greatly affected in spite of reduced thermal insulation. Intensive thermal insulation or even active cooling at little ventilation of diffusion-permeable seat covers may lead to condensation in the colder part of the upholstery, often accompanied by fungus proliferation in these areas which by no means are hermetically sealed, and that is objectionable from the hygienic point of view.

To overcome this inconvenience, seat upholstery has been proposed (W95/14 409, WO 96/05475) with which a fan blows conditioned air under positive pressure through passages and pores in the upholstery to the buttocks and back of the person seated on it. In spite of the very great expenditure, only a minor effect or great energy input may be expected from this known seat upholstery because there is insufficient coordination between the passages supplying and carrying off the drainage air and the person sitting on or leaning against the upholstery. Uncomfortable undercooling due to an intensive by-pass flow must be expected particularly in the marginal regions of a sitting person.

Likewise known is mat-like padding (U.S. Pat. No. 5,004,294; EP 0 689 786 A1) containing a plurality of valves which are controlled to open under the load of a person seated on them. Then conditioned air is blown out through the valves against the buttocks and back of the seated person. With this padding, the valve travel is short compared with the compression of the upholstery so that the padding practically does not contribute to the cushioning effect. The conditioned air which is blown out may cause undesirable undercooling of the body parts mentioned. The problem of discharge of the air enriched with the effluvium from human bodies was not taken into account.

It is known per se to subject foam upholstery to forced ventilation by means of blast air which acts by pressure or suction (DE 31 47 610 A1). A solution for motor vehicle upholstery, working with positive pressure, accomplishes that with a differential pressure of 100–600 mbar (DE 3 705 756 A1).

It is the object of the invention to provide an apparatus for effective and pleasant ventilation of seats, rests, or beds which restricts draft-free ventilation substantially to the parts of the seats or beds contacted by the body, and which can be manufactured and operated at low cost. The apparatus is to be suitable, at the same time, for retrofitting of existing seating and bedding pieces of furniture.

This object is met by seat, rest, or couch upholstery as defined in claim 1. Advantageous modifications of the invention are specified in the subclaims.

According to the invention the flow of draining air is increased automatically or given a desired flow distribution by the surface area pressure exerted by the seated person. That is accomplished by controlling the valve means, preferably connected in parallel, to open because it is only under pressure load or compression that they liberate the cross section of the passage opening. This causes the drainingig air not to be guided past the loaded surface but instead to travel through directly to where the ventilation is intended to have its effect. The flow cross sections of the valve means and the drainage channels may be designed so that even a very small pressure difference in the order of from 50 to 200 Pa and correspondingly little energy expenditure will provide a satisfactory air flow rate.

Retrofit upholstery according to the invention may consist of a gas-permeable, thin cover layer having a high coefficient of heat transmission to serve as the contact surface for the seated person and an underlying, sufficiently thick drainage layer offering little flow resistance and embodied, for example, by open-pore foam or a coarse fiber layer. This drainage layer may be terminated by a substantially diffusion-tight film at the side remote from the seated person.

Only at relatively low room temperatures will heat and steam exuded by the body be evacuated to a sufficient degree through the drainage layer due to the mere buoyancy caused by a difference in density between the warm moist (lighter) and the colder room temperatures. At higher air temperatures that is often inadequate so that the energy-consuming room air conditioning system must be operated although intelligent energy-saving seat air conditioning would suffice. The ventilating flow which dissipates heat and removes moisture may be enhanced by connecting the drainage layer to a low-noise ventilator operating either in the pressure or suction modes and at a rotational speed or volume flow rate which either may be adjustable manually or automatically controllable by way of a temperature sensor and/or moisture sensor and an input reference value element.

In further modification of the invention the draining air flow rate may be adapted to the physical data (size, weight) of the seated person with the aid of a rotary slide valve installed in a cylindrical manifold.

With automobile seats it is self-suggesting to connect the seat and rest upholstery designed according to the invention at the inlet end to the interior ventilating system and an air conditioning system, where available.

In the case of swivel deskchairs where a travelling range, however small, is needed, the seat air conditioning system may be connected by a hose to a suction fan which may be mounted at the ceiling of the room, for instance. Considering the improved sitting comfort, these limitations of the travelling space may be put up with.

As known from U.S. Pat. No. 5,004,294, the valve means may comprise a plurality of valves, for example mushroom-type valves. These valves are opened by the weight of the seated or reclined person against the restoring action of spring elements which have a decisive influence, according to the invention, on the cushioning effect of the upholstery. With pressure operation of the air conditioned seat or bed, the draining air is pressed through the respiration-active cover layer in small spaces, and with suction it is withdrawn accordingly. A channel system through which the draining air may be supplied and removed, respectively, is disposed at the side of the valve sealing surfaces remote from the seated or reclined person. Such valve systems in checker board arrangement offer a solution which saves energy particularly well since the cross section of the drainage channels is liberated for the draining air exclusively in the region of the surface loaded by a seated or reclined person. On the other hand, in a system including channels which are connected in parallel, actuation of a valve in the seat or bed . . . one of the channels throughout the full channel length, i.e. also through the respiration-active upper upholstery of the back rest, the draining air will be conveyed without any need for the seated person to lean against it.

The problems with seating pieces differ from those encountered with bedding pieces in that the association between a seated person and the seating piece, at least in the case of swivel deskchairs and car seats, is relatively precise geometrically, whereas a person lying on a mattress may take all kinds of positions. For this reason an embodiment is preferred for mattresses which is made up of a plurality of valve means arranged over a large area and reacting to being loaded by opening. Also for swivel deskchairs and individual car seats the structure should be such that the draining air sucked off or blown through is not removed unused, bypassing the seated person, but instead is passed through those zones which require intensive dissipation of heat and removal of moisture.

With one embodiment of the invention, the draining air distribution is adapted to persons of differently broad body shape by placing on the seat, rest, or couch an upper template provided with drain apertures in an arrangement specifically adapted to the personal body size.

In especially preferred embodiments of the invention foam elements of the upholstery itself serve as valves, forming a large-area multigonal mosaic, preferably realized as a hexagonal matrix. These foam elements may comprise air-impermeable intermediate layers which, upon pressure loading of this element, contracts the same transversely, thereby liberating cavities for the passage of air so that the draining air channels are brought into fluid communication through the open-pore sections of the foam elements and also through the cavities in question with the drainage channels of the lower upholstery or cavities in a seat shell and through the latter with the pressure or suction operation manifold.

The invention will be described further, by way of example, with reference to diagrammatic drawings, in which:

FIG. 1 is a vertical section through a swivel deskchair comprising upholstery designed in accordance with the invention;

FIG. 2*a*) is a part sectional elevation, on an enlarged scale, of the upholstery shown in FIG. 1;

FIGS. 2*b*) and 2*c*) are sectional elevations along lines IIb) and IIc) in FIG. 2*a*) at two different valve positions of a drainage channel in the upholstery;

FIG. 3*a*) is a part sectional elevation along line IIIa) in FIG. 3*b*), the neck rest containing a manifold;

FIG. 3*b*) is a part sectional view of the neck rest of the chair as in FIG. 1;

Figure 7A:
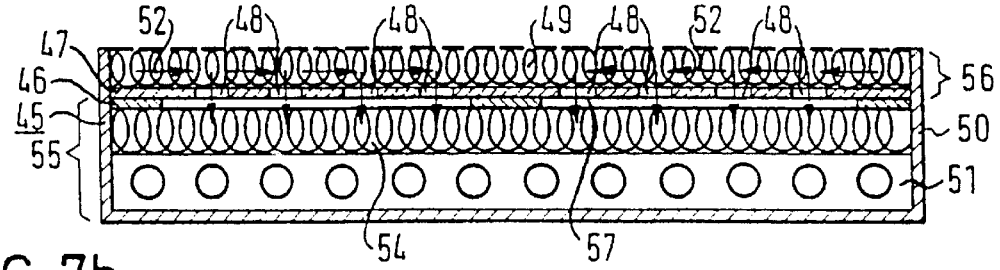
Figure 7B:
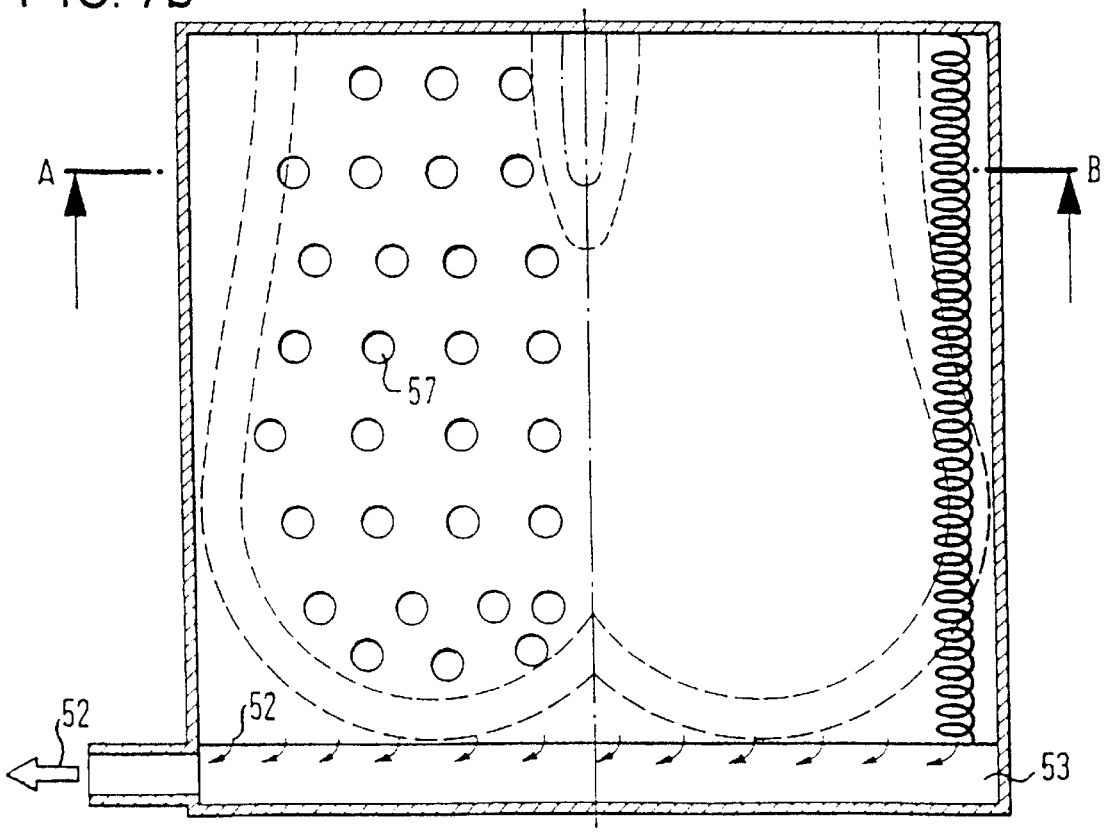

FIG. 7*a*) is a cross section along line A–B in FIG. 7*b*) and

Figure 8:
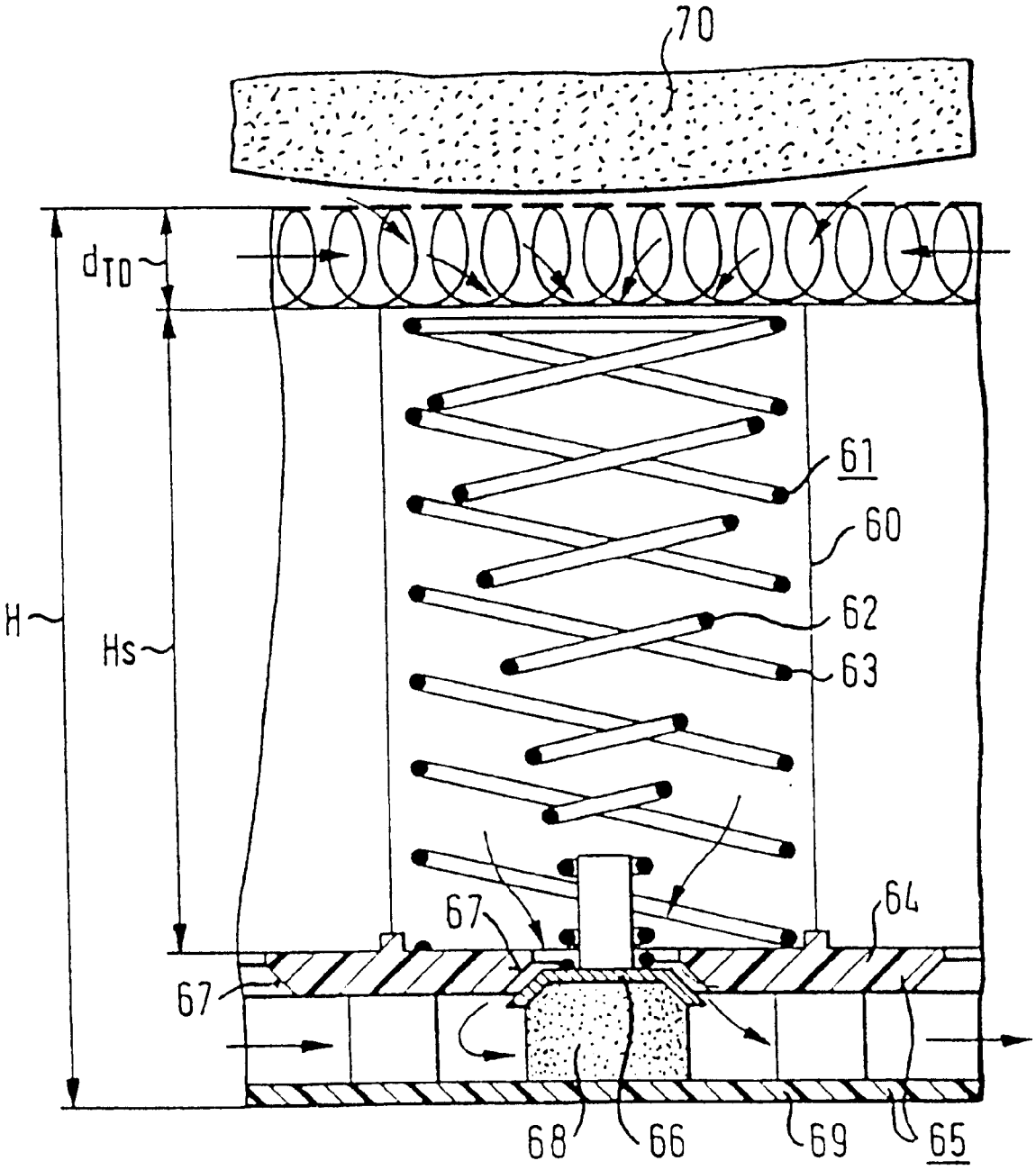
Figure 9:
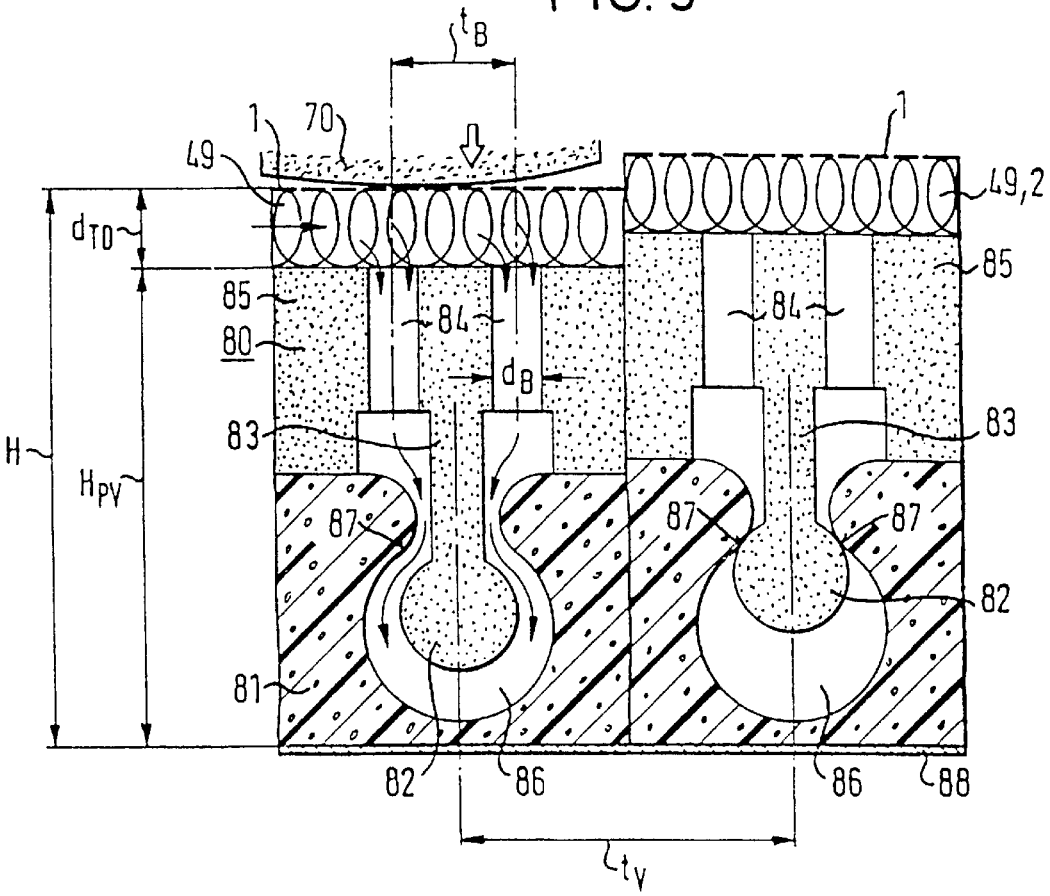
Figure 10:
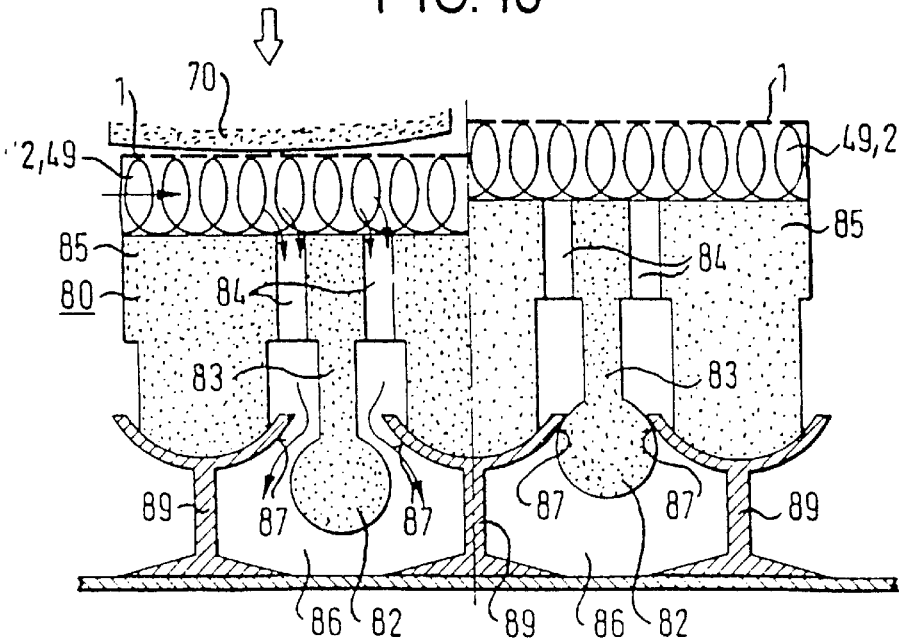
Figure 11:
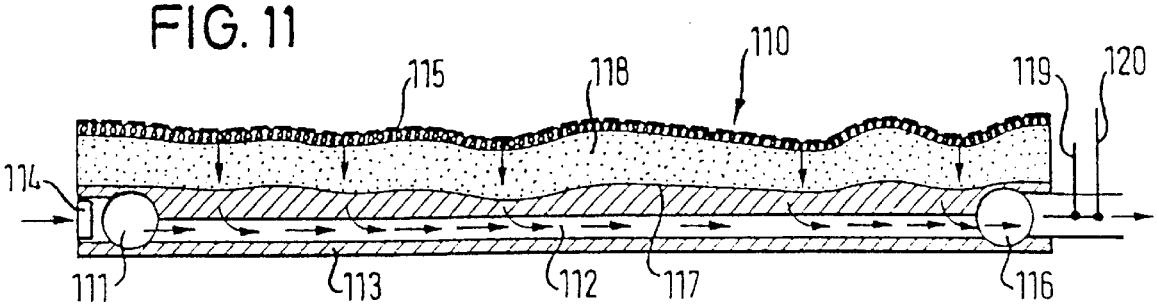
Figure 12:
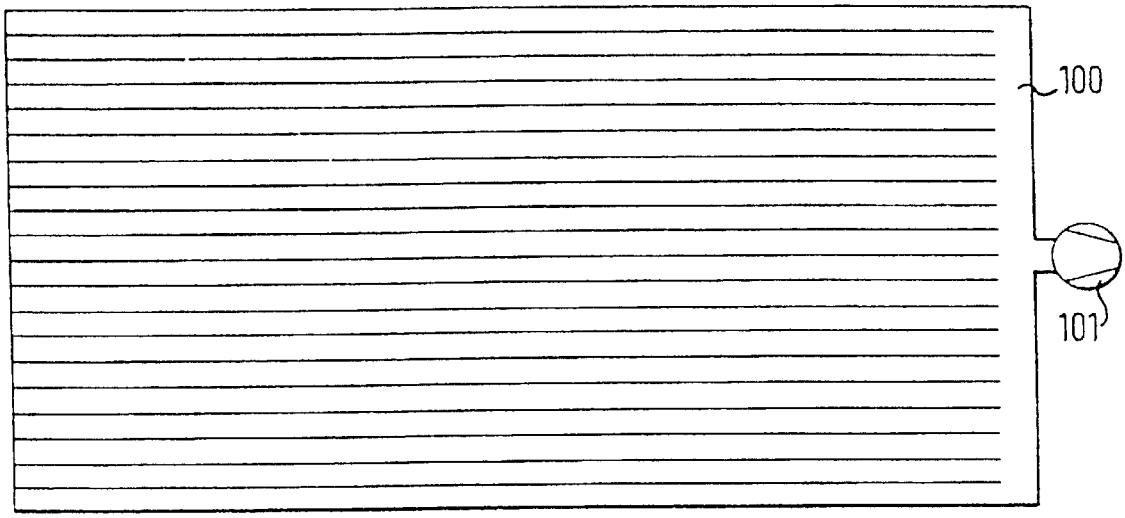
Figure 13:
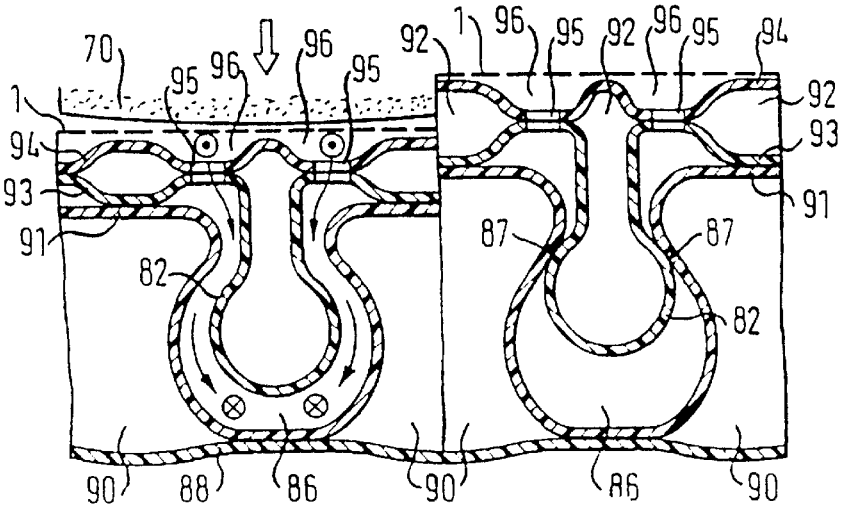

FIG. 7*b*) a diagrammatic top plan view of another modification of seat/rest upholstery according to the invention;

FIG. 8 is a part sectional view of a pocketed spring core type mattress designed according to the invention;

FIGS. 9 and 10 show two examples of further modified upholstery according to the invention, both designed for easy manufacture and assembly, in this case an unloaded part of the upholstery being illustrated at the right side and a loaded part at the left;

FIG. 11 is a longitudinal sectional elevation of mattress upholstery designed according to the invention;

FIG. 12 is a top plan view of an air mattress designed according to the invention, and FIG. 13 is a part sectional elevation, on an enlarged scale, of an inflated air mattress according to FIG. 12.

FIG. 1 shows a swivel deskchair equipped according to the invention with a ventilation system. The contact surfaces 3 and 4 with the seated person are covered by a respiration-active fabric layer 1 offering sufficiently high flow resistance to air being sucked through. Below this fabric layer 1 there is an upper cushion 2 of open-pore material which has a higher stiffness so that it will not be compressed too much under the weight of the seated person. The flow resistance of this upper cushion formed, for instance, with longitudinal ribs in the direction of the spinal column of the seated person, is lowered according to the invention by the weight of the seated person. The open-pore upper cushion 2 includes drainage channels 15 which are connected according to FIG. 1 to a manifold 5 housed in the neck pad 6. From the neck pad, a draining air conduit 7 leads to the suction end of a ventilator 8 whose motor is connected to an accumulator 9 adapted to be recharged via an electrical connection 10. Together with the motor and accumulator the ventilator 8 is housed in a sound-proofed space in the flow of the swivel chair.

The draining air conduit 7 may be laid outside of the backrest and seat to the ventilator if a seating piece of furniture is to be retrofit with such an air conditioning system. In that event a combination is self-suggesting of the ventilator plus accumulator in a flat arrangement (not shown) to be mounted at the backrest.

FIG. 2 illustrates a valve 18 with valve flaps 19 such as used in inflatable water wings. It is installed in each of the parallel drainage channels 15 of the upper cushion 2 (FIG. 1) and remains closed when the seat is in unloaded condition (FIG. 2*c*). Under pressure loading of a seated person, the valve 18 automatically opens the wider (FIG. 2*b*) the higher the local pressure load turns out to be. That is intentional according to the invention because the dissipation of heat and removal of steam are to be the most intensive at locations where there is high pressure loading.

FIG. 3 illustrates a draining air manifold 5 built into the neck pad 6 of the swivel chair shown in FIG. 1, including an internal rotary slide valve 13 the passage opening 17 of which has a profile 14 designed such that the draining air will be distributed to the draining air channels 15, connected in parallel, in response to the body weight and mass by adjusting the rotary slide valve in a corresponding angular position.

Figure 4:
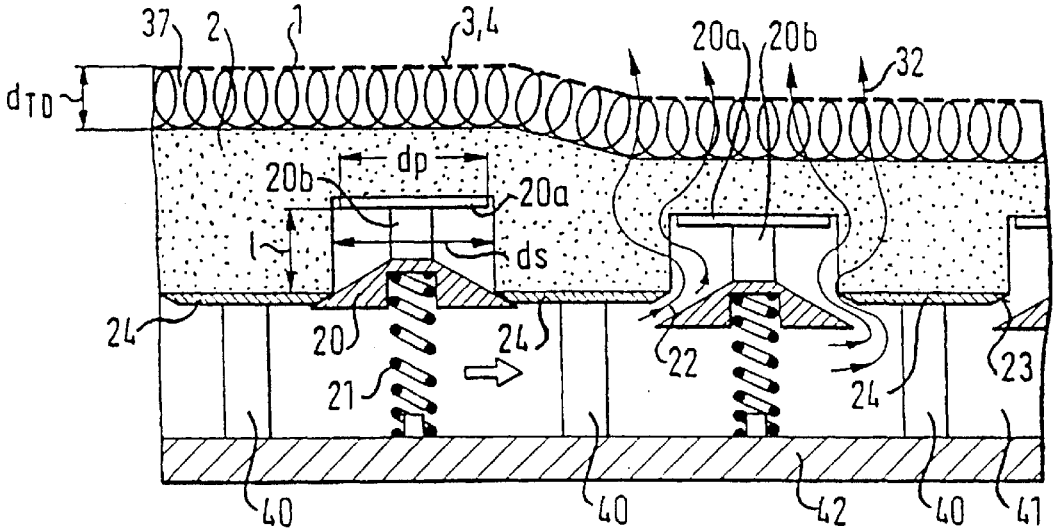
FIG. 4 is a part sectional view of upholstery according to the invention, the right half of the part section shown being loaded by the weight of a person.

FIG. 4 presents a cutout of upholstery according to the invention having a contact surface 3 or 4 with the person seated on or leaning against it. It is covered by a respiration-active fabric layer 1 and padded with an open-pore upper cushion 2. A layer consisting of a plurality of valve closure members embodied by valve discs 20 is disposed below and separate from the upper cushion 2. Upon loading by a person seated on or leaning against it, the valve closure members open against return springs, embodied by helical springs 21, in accordance with the contact pressure profile of that person, thus liberating a flow cross section 22 for the draining air which is supplied and removed, respectively, through drainage channels 41 in the hollow foundation. The valve seats may be embodied by circular openings 23 in a partition 24 supported by spacers 40 on the seat shell or a base 42. The length of travel of the helical springs 21 has a decisive codeterminative influence on the cushioning effect.

Figure 5:
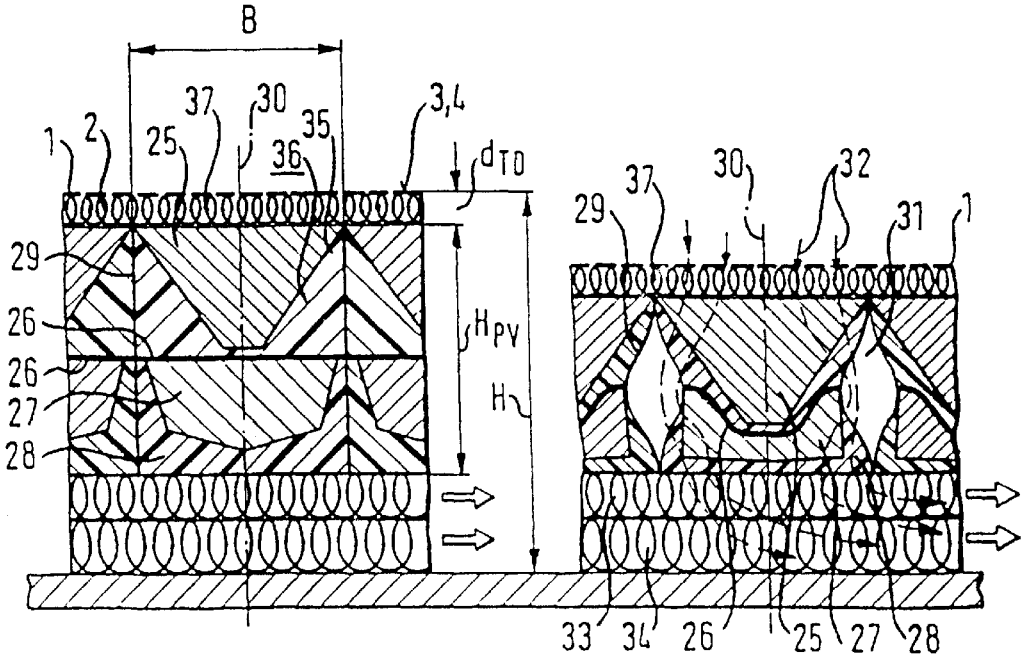
FIG. 5 is a part sectional view of modified upholstery according to the invention, the part of the upholstery shown at the right being loaded by the weight of a person, just like in FIG. 4.

FIG. 5 presents a cutout of another embodiment of the invention, comprising a contact surface 3 or 4 with the person seated on, leaning against, or lying on it. The valves are realized by foam elements of the upholstery structured accordingly. An unloaded cutout is illustrated at the left and a loaded cutout at the right.

The foam elements 36 which preferably are made hexagonal and glued with open pores to the conventional upper cushion 37 and which, therefore, may be combined to form a regular matrix have the following structure. The pressure exerted by the seated person presses a conical stamp 25 of open-pore foam material, enclosed by a somewhat softer ring 35 of open-pore foam material, against a largely air-impermeable, flexible intermediate layer 26 which, however, is hard to stretch in longitudinal direction, into an open-pore stamp pad 28 filled with soft foam 27 and, thereby, pulls the boundary 29 of the element towards the axis 30. In this manner an annular cavity 31 is formed around each of the loaded elements. Through this cavity 31 fluid communication is established among the open-pore stamps 25 and stamp pad portions 27, 28 and with the drainage channels 41 in the seat shell or lower cushion 33, 34, which are discharging the draining air 32.

Figure 6:
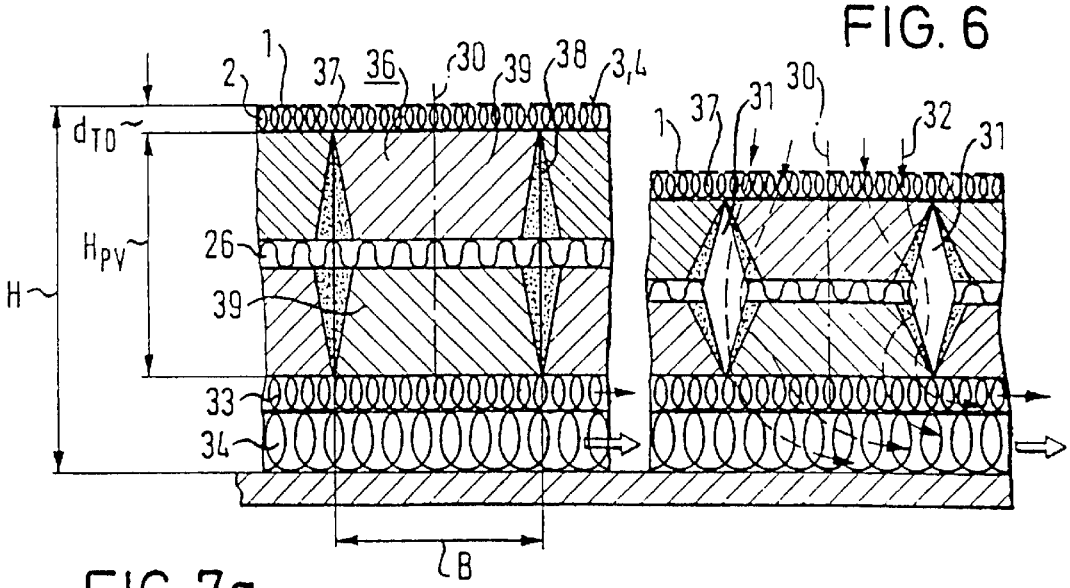
FIG. 6 shows another modification of upholstery according to the invention, once again the partial cutout of the upholstery shown at the right being loaded by the weight of a person.

FIG. 6 presents another variant. Here the transverse contraction of the hexagonal elements 36 is caused by a cylindrical dent surface 38 enclosing an open-pore core 39 which is soft to transverse compression. The stiffness of the dent surface 38 is such that, under pressure loading of the elements 36, the dent surface dents towards the axes 30 thereof so that an annular cavity 31 is formed through which the open-pore regions enter into fluid communication with the coarse-porous lower cushion 33, 34 which discharges the draining air, bypassing the sealing intermediate layer 26.

The valves of foam material constitute the principal cushion which generates the cushioning effect of the variant embodiments according to FIGS. 5 and 6.

The embodiments illustrated in FIGS. 5 and 6 can be made at little expenditure in the following way:

First the upper cushion 2 is prepared. To that end, open-pore foam of low transverse contraction stiffness is injected into a mold corresponding in shape to the stamps 25 or cores 39. Subsequently, the annular intermediate layer 26 of somewhat harder, open-pore foam is injected into the spaces in between.

The bottom of the upper part thus formed is laminated with an air-impermeable layer which is soft to transverse compression. Thereupon the intermediate layer 26 is cut along the central surface by a honeycomb-like hexagonal punching tool. This upper part then is glued on a congruent lower part, prepared in the same fashion, the glue being applied only in the central area of the cores.

In the case of modified manufacture, hexgonal members are prefabricated and subsequently configured in mosaic fashion to form a structure having a surface area. The hexagonal members according to FIGS. 5 and 6 are glued with open pores to air-permeable cover and base layers of great surface areas.

FIG. 7 illustrates another embodiment of upholstery according to the invention. The air flow is indicated by arrows. The seat or seat pad 45 is equipped with a draining air-permeable base template 46 adapted to persons of broad build. The slighter ones will bring into position a top template 47 of corresponding smaller surface area, provided with drain apertures 48, and equipped with a coarse-pore upper cushion 49 for transverse conveyance of draining air under the seated person. The back rest may have a corresponding structure.

A coarse-porous base layer 51 for conveyance of the draining air 52 is provided along the drawer-like, air-impermeable seat or rest shell 50. Helical springs disposed parallel to each other or twisted into each other lead towards the draining air manifold or manifolds 53, thus presenting a fluidic connection with little pressure loss. To enhance the sitting comfort, soft, open-pore lower upholstery 54 or upholstery with draining air apertures extending substantially vertically with respect to the seat or rest is located on top of this "coarse-porous" base layer 51.

The base template 46 described above lies on this lower upholstery as cover layer of the lower cushion 55. The upper cushion 56 is placed on the lower cushion, and the bottom surface of the upper cushion forms the person-specific top template 47. This top template 47 is provided with a pattern of apertures or slits 57 for passing air, as seen at the left side of the top plan view, permitting optimum dissipation of heat and removal of moisture, e.g. along the spinal column down to the coccyx and in the region of the crotch and also at the highly loaded "cheek bones". An open-pore drainage layer 49 having a low flow pressure loss coefficient is provided on the top template as well so as to let draining air enter from the sides with little pressure loss and then flow under the person seated on or leaning against the upholstery, all the way to the flow sinks 57 in the upper template. This upper upholstery likewise may have a rib-like or spiral structure particularly favoring the entry of air from the unloaded sides. The recommended cover material is a net-like fabric having good heat conductivity.

The modification of the invention presented in FIG. 8 is advantageous for beds, especially for pocketed spring core mattresses, but is useful as well for any sophisticated seat structure.

The helical spring in each bag 60 is realized as a unitary "reversing spring" 61 having, for example, a conical core 62 surrounded by a cylindrical spring section 63. The cylindrical spring section rests on the upper bottom 64 of the hollow lower bottom 65, while the slightly shorter, conical interior spring section pulls a valve disc 66 into the valve seat 67 when the mattress is not loaded. Upon loading of the mattress by a person 70 sitting or lying on it, the valves in the individual bags open to different degrees, depending on the local pressure exerted. The valve disc thus is pressed against an elastic member 68 the stiffness of which, in combination with that of the reversing spring, determines the opening and closing characteristics of the valve. However, a largely local sink flow at the loaded place is not achieved with this configuration unless the sidewalls of the bags 60 or of groups of bags have a relatively great flow resistance, as obtainable with linen fabric by spraying it with natural latex, for instance. What is important is that the pressure loss of the mattress for the air sucked through the mattress is low at sufficiently loaded places in order that satisfactory conveyance of draining air will take place even at a low pressure difference of the ventilator in operation, as indicated here by arrows, in correspondence with a low energy requirement. In non-loaded zones, the mattress of course is to be largely impermeable to air.

The hollow lower bottom 65 consisting of a closed outer cover 69 and of the upper bottom 64 which includes the valve seats 67 may be made flexible, for example of sufficiently stiff natural caoutchouc so that with this mattress, too, adjustment of the support is possible without any problems.

FIGS. 9 and 10 show two embodiments of upholstery according to the invention that are favorable in terms of manufacture and assembly.

FIG. 9 is a cross sectional presentation of the element of an advantageous variant embodiment, loaded at the left side and unloaded at the right side. Like the embodiments shown in FIGS. 4 to 8, the upholstery contains valves with valve closure members 82 and sealing valve seats 87. Here the upholstery of a seat or bed consists of a lower upholstery 81 which is produced of somewhat stiffer closed-pore foam and an upper upholstery 80. The upper upholstery 80 has a bar-like valve closure member 82 made of closed-pore foam in the shape of a rib-like thickened portion at a web 83 and connected to a compensating layer 85 which is a softer, open-pore material provided additionally or instead with drainage through-bores 84. The lower upholstery 81 includes cylindrical cavities 86 extending throughout its length and serving as drainage channels. The cavities are open upwardly through elongate slits or constrictions. At either side of these constrictions line-shaped valve seats 87 are formed. The webs 83 with the valve closure members 82 project through the constrictions into the cavities 86. The lower upholstery 81 is laminated at the bottom with a largely air-permeable cover layer 88 which is made to be flexible with mattresses. In accordance with the pressure load transmitted from a person 70 seated or reclined, the rib-like valve closure members 82 are pressed into the cylindrical cavities 86 of the lower upholstery and consequently lift off the valve seats 87. Thus fluid communication is established from the surroundings to below a person 70 seated or reclined on the upholstery and, underneath the loaded upholstery section, to the cavities 86 which may be connected to a ventilator operated in the suction or pressure mode.

For simple assembly, the compressible valve closure members 82 of the upper upholstery are squeezed from above through the valve seats 87 of the lower upholstery or pushed in laterally. In unloaded state, the valve closure members 82 sealingly engage the valve seats 87 under minor bias. Again the valves are integrated in the upholstery, as with the variants shown in FIGS. 5 and 6.

With the embodiment shown in FIG. 10, the lower upholstery is made up of strip-shaped elements 89 constituting the line-shaped valve seats 87 and the cavities 86. Especially with seats and rests made by applying the upholstery to a firm shell, as in FIG. 10, the strip-shaped elements mentioned are stiff and may be made integral with or connected to the seat shell. Here, the full spring and valve closing path is accommodated in the upper cushion 80. Moreover, the valve closure members 82 are designed to be sufficiently compressible if they are to be squeezed through the valve seats 87 into the larger drainage cavity 86 in the lower bottom on first assembly.

This configuration remains easily dismantable for cleaning or recycling because bonding between the upholstery and the seat shell is not necessary.

It is obvious that the design principle which comprises pressing the valve closure members through the valve seats for assembly, is applicable not only with two-dimensional but also with conventional circular valves. In this case the valve closure members 82 in FIGS. 9 and 10 are to be understood as being rotationally symmetric (spherical) elements, while the constrictions with the valve seats 87 are conical bores. Assembly in this case can be accomplished only by squeezing but not by laterally pushing the upper upholstery into the lower upholstery.

With presently available manufacturing processes for foam products the valve layer of elements 82, 87 might be made very thin, e.g. with a thickness of no more than 10 mm, up to the thickness of a strong cover fabric. In this case a laminated valve pad might be laid, as a thin seat cushion, on lower upholstery which now would be realizable very easily and which is connected by a surface area to a draining air supply source. To permit entry of draining air under a seated person, the side of the laminated valve pad facing that person could comprise a rib structure for example, to form a groove-like upper drainage which might be covered by an open-pore, yet tough, i.e. not stretch-like cover fabric. The latter acts as a dust filter to prevent rapid interior contamination of the valve layer and as a barrier layer against blocking of the flow of the upper drainage e.g. by fibers of woollen fabric being pressed into these clearances under the pressure of a person sitting on it.

If the pressure loading of the upholstery is provoked by an object which itself is not air-permeable the conditioning air in the upper drainage layer 37 (FIGS. 4 to 6) may be carried off laterally because this drainage layer is made to have very good transverse permeability as a tangential drainage layer. FIGS. 4, 5, and 6 show upholstery with which air permeability of a contacting article was started from, such as is given with controlled cooling of porous products, whereas air permeability of the loading article is excluded with FIGS. 7 to 10.

It is a problem with the upholstery according to the invention that no air is passed through in the unloaded event, as would be desirable, for instance, to cool a vehicle seat before the passenger sits down. To solve that problem, it is provided in accordance with the invention that the ventilator be equipped with an overload stage so that switch-on of this stage will generate a much increased suction vacuum in the cavities due to which the valves will open even without loading by a seated person.

The matress 110 designed according to the invention, as shown in longitudinal section in FIG. 11, and comprising, for instance, a multi-upholstery layer 118 with integrated valves according to FIG. 9, has an air inlet channel 111 at the foot end communicating with all the drainage channels 112 in the lower upholstery 113. The air inlet channel can be connected to ambient atmosphere via an adjustable throttle valve indicated at 114. When this throttle valve 114 is fully open the flow of draining air through the bed 115 on which the person is lying would be largely reduced because the low pressure in the drainage channels 112 would be greatly lowered by the opening of the throttle valves. That permits easy adaptation to seasonal conditions. Moreover, the moisture fed into the mattress during the sleeping period may be expelled from the zone downstream of the valve layer 117 by switching on the ventilator in the manifold 116 and opening the throttle valve 114.

Normally, mattesses should be positioned upright from time to time to ventilate them. That is difficult to do, especially for older people, and it becomes superfluous with the configuration described according to FIG. 11. Switch-off times or adjustment values for the ventilator may be preset by means of a moisture sensor (at 119) installed upstream of the suction fan (not shown) and/or a temperature sensor (at 120). Alternatively, a timer may be provided to limit the operating period of the ventilator to two hours. The exhaust air stream thus may be controlled adjustably in response to moisture and temperature to adapt it to the requirements of the sitting or lying person.

The modification illustrated in FIGS. 12 and 13 presents a further development of the design of FIGS. 9 and 10 to an inflatable air mattress. Here the lower upholstery 81 to be seen in FIGS. 9 and 10 has been replaced by inflatable hollow chambers 90 obtained by gluing together the air-tight bottom 88 and the air-tight protuberances 91 which form the valve seats 87.

The upper upholstery 80 is replaced by a system of inflatable hollow chambers 92 obtained by gluing together a bottom layer 93 which forms the valve closure members 82 and a top layer 94. In the region of the bond, the upper upholstery is provided with apertures 95. Draining air may flow through these apertures from the upper upholstery into the cavities upon loading of the mattress. The top layer 94 which is undulated after inflation is covered by a porous cushion layer 1.

Draining air finds its way through the cavities 96 between the porous layer 97 and the top layer 94 to underneath the lying person 70 towards the flow sinks which develop by pushing the valve closure members 82 away from the valve seats 87 in accordance with the person's load profile. The draining air is passed through the cavities 86 which are combined by way of a manifold 100 (FIG. 12) to a mini-ventilator 101. Here, too, ventilation, in many cases sufficient, can be achieved by thermic effects without connection to a ventilator operating in the suction or pressure mode.

The air mattress according to FIGS. 12 and 13 can be folded together to a small volume and, during trips to areas where hygiene is not perfect, it offers protection on hotel beds against infections and parasites, especially when operating in the suction mode. And this is not achieved at the expense of impermeability to air, otherwise typical of air mattresses, and the resulting profuse perspiration.

Let us assume, for purposes of estimating the maximum air flow required to ventilate a mattress according to the invention, that the air in a room at a temperature of 27° C. has a relative humidity of 90%. Under these conditions a human being would evaporate approximately 1 liter of water in the course of one night. Half of that could be stored in the mattress without any remedial measures being taken. If one assumes the draining air to be warmed up by 5° C. and brought to 95% relative humidity, the volume of draining air required is calculated to be about 50 kg distributed over 10 hours, in other words, approximately 6 $m^3$ of air per hour. Together with the suction vacuum required of about 100 Pa, at a pumping efficiency of 30%, this volume of draining air results in electrical power of no more than about 0.5 W. If the lying person covers a surface area of 0.5 $m^2$ the resulting average orthogonal flow velocity is no more than about 4 mm/s. Such a velocity of air is not perceived as unpleasant draft. Extremely low-noise mini-ventilators are commercially available for this kind of application.

The following statements are made with respect to the dimensioning of the drainage channels or aperture size of the valve means:

FIGS. 4 to 6 as well as 8 to 13 are sectional elevations of upholstery which are largely true to scale, and they show valve means integrated in the upholstery according to the invention and suitable for elastically dampening a great distance, as compared to the layer thickness of the upholstery, of from 20 to 80% of the total thickness of the upholstery.

In view of the low differential pressure aimed at in the order of 100 Pa, supplied by the operating ventilator, the flow velocities occurring in the drainage channels always must be low since the dynamic pressure of the flow already amounts to about 60 Pa at a flow velocity of 10 $ms^{-1}$. The coefficient of pressure loss of the branched system of drainage channels should be as small as possible in consideration of the fact that the flow is not rectilinear but takes a tortuous course and passes many variations in cross section, as may be gathered from FIGS. 9 and 10, for instance. Ideal conditions exist where the tangential drainage channels 37 (FIGS. 4 to 6) or 49 (FIG. 7) next to the seated person as well as the bores 84 and the drainage cavities 86 in the base of the upholstery (FIGS. 9 and 10) have the smallest possible pressure loss so that the local cooling air flow rate will be controlled exclusively by the weight of the contacting person via the cross sections of the valve openings between the valve closure members and the valve seats.

In the case of the embodiment according to FIG. 4 the valve means are given dimensions such that the valve closure members 20 can travel for a length l of about 50% at the most of the thickness of the upholstery. Even at the end of this travel, the valve still has a residual opening cross section sufficient for ventilation because the plate-like cover 20*a* at the end of the valve axis 20*b*, improving the seat comfort, has a smaller diameter dp than the valve seat ds.

Also in FIGS. 5 and 6 the dimension of the valves made of upholstery foam may be seen largely true to scale. While the upper drainage layer 37 and the lower drainage channels or layers 33, 34 primarily are to be made flexible and hardly compressible, the upholstery valve layer 36, 39 is designed to be both flexible and compressible. The dimensions B and $H_{PV}$ of the valves which, for example, are made hexagonal should be in the order of from 40 to 90% of the overall thickness H of the upholstery structure, which normally is between 50 and 200 mm. The thickness $d_{TD}$ of the tangential drainage layer 37 disposed towards the contacting person should be between 3 and 15 mm. The same applies to the lower drainage layer or drainage channels which may be composed of a finely structured layer 33 and a coarser layer 34.

In accordance with the embodiment shown in FIG. 8 the essential element which determines the cushioning effect, namely the helical spring 61, itself is the elastic adjusting member for the valve disc 66. The helical spring 61 has a height Hs which corresponds to from 60 to 80% of the thickness H of the mattress. The spacings which are usual with innerspring mattresses or pocketed spring core mattresses may be maintained.

The statements made with respect to FIGS. 4 to 6 and 8 apply mutatis mutandis to FIGS. 9 and 10. With the latter variant, however, the height $H_{PV}$ of the upholstery valve, in this case designed to be linear or cylindrical in the longitudinal direction of the upholstery, may amount up to about 95% of the overall thicknes H of the upholstery since the lower drainage 86 is integrated in the lower upholstery 81 which forms the valve seat. The distance $t_v$ between adjacent linear valves may vary between approximately 0.3·H and 1.5·H. The diameter $d_B$ and the pitch $t_B$ of the drainage bores may vary within wide limits, as known in the art of upholstery, of course with the aim of realizing the smallest possible pressure loss.

In conclusion it should be emphasized that the energy consumption for the upholstery providing a pleasant lying climate to a mattress according to the invention is lower by orders of magnitude than the expenditure. involved in a room air conditioning system. In modern split design such a room air conditioning system costs many times as much as the additional equipment of a matress designed according to the invention.

What is claimed is:

1. Air-permeable upholstery comprising channels through which air can flow via a valve means which control the flow of air through the channels, the valve means being positively controlled to open by loading of the upholstery, the valve means including closing and restoring members being constituted by pliable elements, characterized in that the closing and restoring members form component parts of the upholstery itself, and that the upholstery including the closing and restoring members are supported on a base (42, 69, 88, 113) and the upholstery characterized in that a plurality of cylindrical foam elements (36) including stamps (25) and stamp pads (27, 28) are arranged below an open-pore upper cushion (37), the stamps and stamp pads being separated from each other by an air-impermeable, flexible intermediate layer (26) such that, under pressure loading by a sitting or lying person, the intermediate layer (26) is pressed into the soft stamp pads (27, 28), thereby becoming deformed so that the intermediate layer (26) dents one of said plurality of cylindrical foam elements (36) to form an annular cavity (31), whereby fluid communication is established between said open-pore upper cushion (37) and an open-pore base layer (33, 34) and drainage channels (41).

2. The upholstery as claimed in claim 1, characterized in that each foam element (36) comprises a cover surface and a shell surface (38) enclosing a core (39) which is adapted to yield under transverse compression, and that said shell surface (38) becomes dented towards an axis (30) of the foam element (36) under pressure acting on said cover surface so that an annular cavity (31) results through which fluid communication is established between open-pore regions of upper and lower drainages (33, 34; 37, 38), bypassing the air-impermeable intermediate layer (26).

3. Air-permeable upholstery comprising channels through which air can flow via a valve means which control the flow of air through the channels, the valve means being positively controlled to open by loading of the upholstery, the valve means including closing and restoring members being constituted by pliable elements, characterized in that the closing and restoring members form component parts of the upholstery itself, and that the upholstery including the closing and restoring members are supported on a base (42, 69, 88, 113) and the upholstery comprising a pocketed spring core type upholstery, characterized in that each spring (61) is designed as a unitary reversing spring having a cylindrical exterior section (63) and a conical core section (62), that the cylindrical exterior section (63) is guided in a substantially air-impermeable bag (60) and rests on a hollow lower bottom (65) and the conical core section (63), in unloaded state, pulls a valve disc (66) into a valve seat (67) such that the valve disc (66) will be pressed into open position under pressure loading by a sitting or lying person, whereby communication is established with a cavity, forming a drainage channel, in the lower bottom (65).

4. Air-permeable upholstery comprising channels through which air can flow via a valve means which control the flow of air through the channels, the valve means being positively controlled to open by loading of the upholstery, the valve means including closing and restoring members being constituted by pliable elements, characterized in that the closing and restoring members form component parts of the upholstery itself, and that the upholstery including the closing and restoring members are supported on a base (42, 69, 88, 113) and the upholstery characterized in that each valve means comprises a valve closure member (82) and a valve seat (87) through which the valve closure member extends and against which it abuts sealingly when the upholstery is in unloaded condition and in that the valve closure member (82) is formed by a rib-like thickened portion at the end of a web (83) which passes through an elongate constriction of a cavity (86) forming a drainage channel.

5. Air-permeable upholstery comprising channels through which air can flow via a valve means which control the flow of air through the channels, the valve means being positively controlled to open by loading of the upholstery the valve means including closing and restoring members being constituted by pliable elements, characterized in that the closing and restoring members form component parts of the upholstery itself, and that the upholstery including the closing and restoring members are supported on a base (42, 69, 88, 113) and the upholstery characterized in that the channels are connected to at least one manifold (5) comprising a ventilator (8) and that loading which opens the valve means is obtainable by controlling the ventilator to an especially high negative pressure.

6. The upholstery as claimed in claim 5, characterized in that said ventilator (8) is a suction fan.

* * * * *